US006435699B2

(12) United States Patent
Glowach, Sr. et al.

(10) Patent No.: US 6,435,699 B2
(45) Date of Patent: Aug. 20, 2002

(54) LAMP HOUSING WITH CONTROLLED COOLING

(75) Inventors: Edward R. Glowach, Sr., Plano; Carroll L. Peterson, Van Alstyne; Bryan R. Teichgraeber, Frisco, all of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/727,605

(22) Filed: Dec. 1, 2000

Related U.S. Application Data

(60) Provisional application No. 60/168,690, filed on Dec. 3, 1999.

(51) Int. Cl.[7] ..... F21V 29/00
(52) U.S. Cl. ..... 362/294; 362/373
(58) Field of Search ..... 362/294, 373, 362/362

(56) References Cited

U.S. PATENT DOCUMENTS 3,766,377 A * 10/1973 Junginger ..... 362/294
6,068,385 A * 5/2000 Hsieh ..... 362/188
6,095,671 A * 8/2000 Hutain ..... 362/373

* cited by examiner

*Primary Examiner*—Thomas M. Sember
(74) *Attorney, Agent, or Firm*—Charles A. Brill; Wade James Brady, III; Frederick J. Telecky, Jr.

(57) ABSTRACT

A housing for a compact high intensity lamp. The housing has a shell whose inner surface generally conforms to the outer profile of the lamp, except at the lamp face. A small air space exists between the inner surface of the shell and the outer profile of the lamp. The shell receives air at an air intake port, and the air circulates in the air space, and exits from an air exhaust port. The shell and the lamp both rest on an alignment collar, that aligns the lamp to the shell and aligns the lamp to other equipment with which it is to be used.

14 Claims, 4 Drawing Sheets

LAMP HOUSING WITH CONTROLLED COOLING

This application claims priority under 35 USC §119(e) (1) of provisional application Nos. 60/168,690 filed Dec. 3, 1999.

TECHNICAL FIELD OF THE INVENTION

This invention relates to lamps and illumination systems, especially compact high intensity illumination systems, and more particularly to a lamp housing that provides controlled cooling for the lamp.

BACKGROUND OF THE INVENTION

Compact high intensity lamps are used in a wide variety of applications. High intensity is especially desired in imaging and display applications, such as for cameras and projection display systems. Examples of lamps used for such applications include short arc lamps and capillary lamps.

For such applications, the compact high intensity lamps may be either stand alone components or integrated into larger equipment. In either case, various housings are used to protect from mechanical damage and shield the lamp illumination.

Lamp cooling is often accomplished with some sort of convection or fan cooling. Some types of housings are designed to minimize ozone emissions, and use some sort of liquid cooling because convection or fan cooling would direct ozone outside the housing.

SUMMARY OF THE INVENTION

One aspect of the invention is a housing for containing and cooling a lamp. The housing is generally comprised of two pieces: a lamp shell and an alignment collar.

The lamp shell contains the lamp, and has an inner surface that generally conforms to the outer profile of the lamp but is slightly larger than the lamp. The result is an air gap between the inner surface of the housing and the outer profile of the lamp. The lower perimeter of the shell is open around the face of the lamp so that light may emit from the housing. The lamp shell has an air intake port for receiving air and an air exhaust port for exhausting air. The intake port and the exhaust port are on opposing sides of the shell such that the air at the intake port divides and travels inside the shell in two paths around the lamp. The shell may be further configured so that air travels past the face of the lamp and inside the reflector (where the face of the lamp is not covered).

The alignment collar provides an interface between the shell and a mounting surface. The collar has an inner top ring for supporting the bottom edge of the lamp reflector and has an outer top ring for supporting the shell. Like the shell, the alignment collar open to the face of the lamp so that light may emit from the housing.

An advantage of the invention is that it provides uniform cooling of the lamp, both to the sides and the front of the lamp. The efficiency of the cooling permits the use of a less powerful and more compact blower. This, as well as the containment of the air within the housing, minimizes noise.

Furthermore, the housing accurately aligns the lamp relative to the equipment with which the lamp is to be used. The alignment can be accomplished for mechanical, electrical, and optical components of the lamp.

The housing and lamp can be easily assembled and sold as a replacement module.

DETAILED DESCRIPTION OF THE INVENTION

Figure 1:
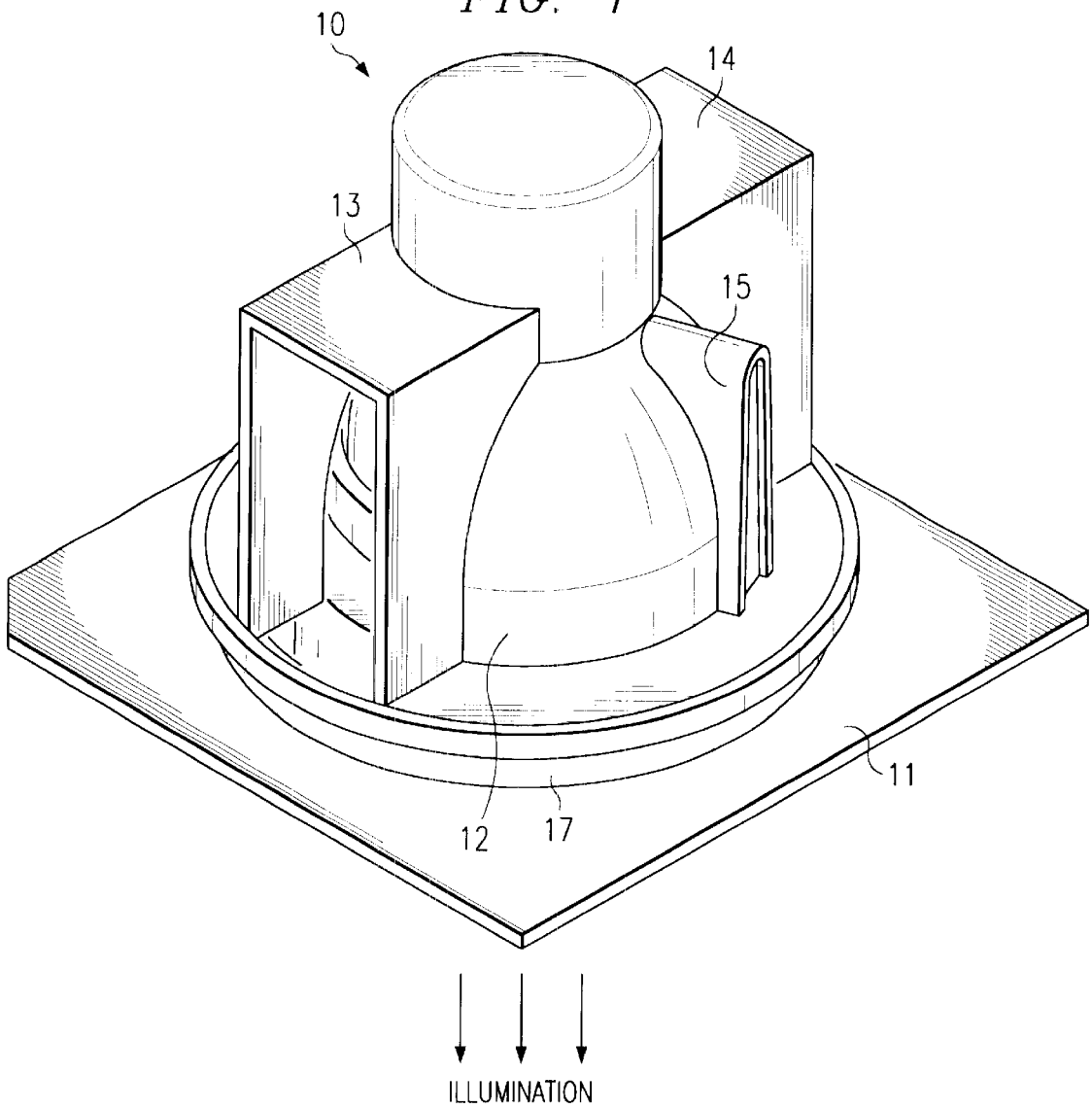
FIG. 1 is a perspective view of a lamp housing in accordance with the invention.

FIG. 1 is a perspective view of a lamp housing 10 in accordance with the invention. A lamp (not visible) is contained within housing 10 and illumination from the lamp is directed out of the housing 10 in a downward direction.

In the example of the description, lamp housing 10 is mounted on the chassis of a projection display system, with a surface portion 11 of the chassis being illustrated. However, housing 10 could be similarly mounted on any surface.

Figure 2:
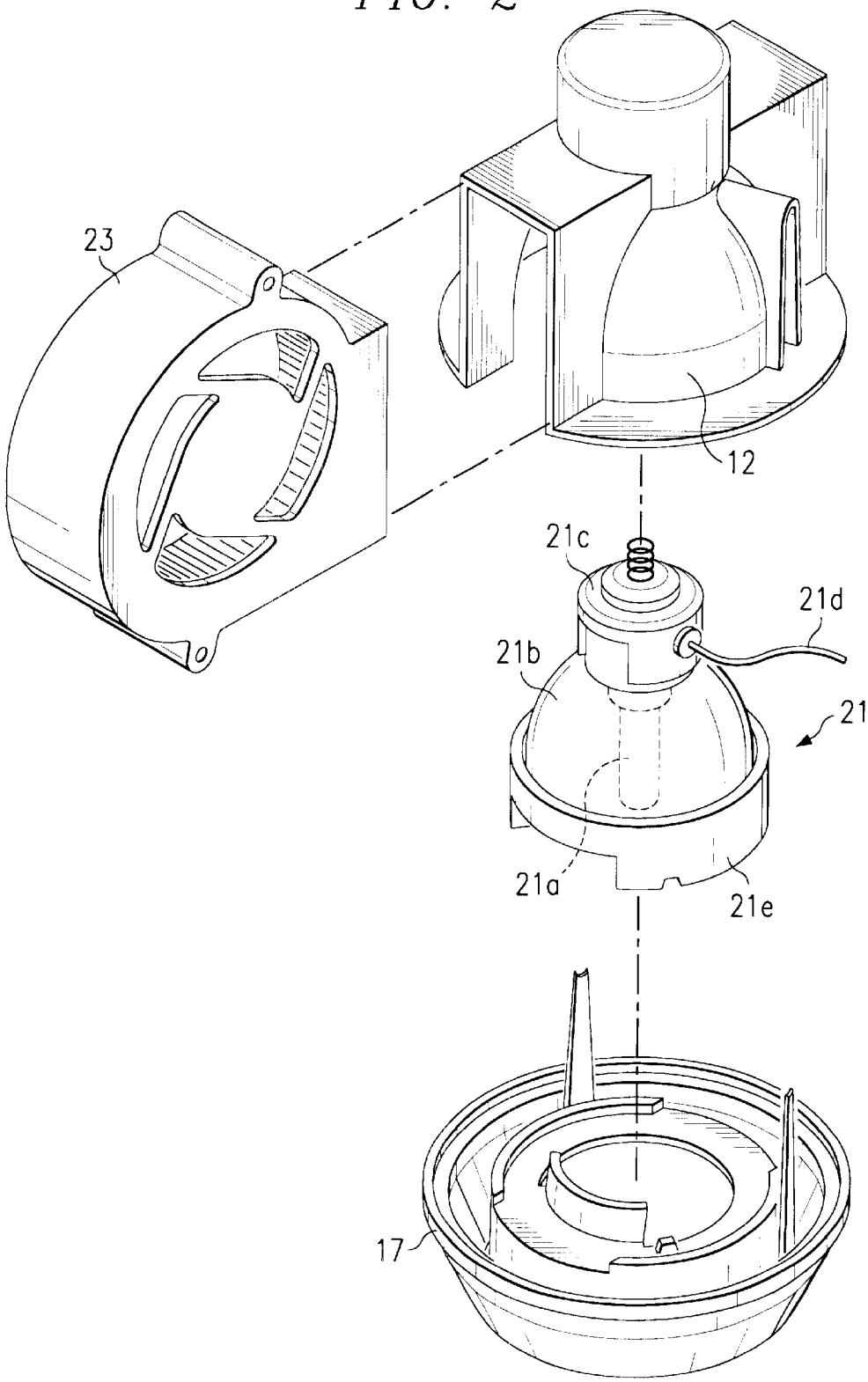
FIG. 2 is an exploded view of the lamp housing, a lamp, and a blower.

FIG. 2 is an exploded view of lamp housing 10 relative to a lamp 21 and blower 23 with which it is used. In actual use, lamp 21 would be contained within shell 12. Blower 23 would abut housing 10, such that air from the blower 23 enters housing 10.

Lamp 21 may be a very high intensity lamp. An example of a lamp 21 for which housing 10 is suitable is an arc lamp used in a projection display system. For such applications, a suitable lamp 21 might be a 270 watt lamp for providing the high lumens needed for quality displays.

Lamp 21 has an electrode 21*a*, reflector 21*b*, base 21*c*, wire lead 21*d*, and rim 21*e*. In the example of FIG. 2, the face of lamp 21 is open, but it might alternatively have some sort of transparent cover.

Blower 23 may be any forced air source, including centrifugal blowers or fans. As explained below, housing 10 provides a controlled air flow for cooling lamp 21, which permits blower 23 to be small. An example of a suitable blower is a 12 volt, 0.7 amp Nidec Gamma 30 blower, manufactured by Nippon Densan Corp. of Japan In the example of this description, where housing 10 is used with a projection display system, typical dimensions of housing 10 might be approximately five inches high and four inches wide.

Referring to both FIGS. 1 and 2, housing 10 is comprised of a lamp shell 12 and an alignment collar 17. Shell 12 and collar 17 may be made from any rigid material capable of withstanding high heat. A suitable material is hard plastic. As explained below, shell 12 and collar 17 are separate pieces that are assembled together after lamp 21 is placed on collar 17. Then, shell 12 may be placed over the lamp 21, and the entire housing 10 may be mounted onto chassis 11 or other surface.

Lamp shell 12 has an inner surface that generally conforms to the outer surface of the lamp 21. In the example of FIGS. 1 and 2, the outer profile of the lamp 21 generally has a curved reflector portion and a cylindrical base portion, and the inner surface of shell 12 conforms to the shape of both portions. However, lamp 21 could be any shape, in which case the inner surface of shell 12 would be modified accordingly. The spacing between the inner surface of shell 12 and the outer surface of the lamp 21 is close. A typical spacing might be ¼ inch.

Shell 12 has two openings at opposing sides of shell 12. An air intake port 13 receives air from blower 23. The air circulates within shell 12 in the space between shell 12 and the lamp. The air splits into two paths, generally in the same direction but one path around each side of the lamp. The two paths join at the other side of the lamp, and the air then exits from air exhaust port 14. In the example of FIG. 1, both ports are rectangular in shape but other geometries are possible.

Figure 3:
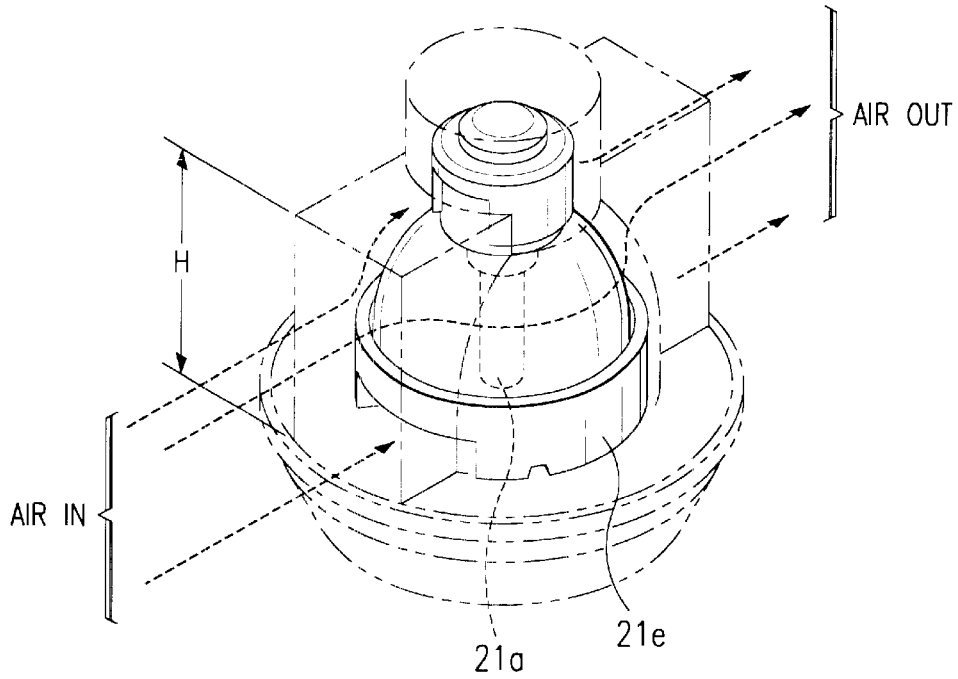
FIG. 3 illustrates the air flow within the lamp housing around the lamp.

FIG. 3 illustrates the air flow within housing 10. It further illustrates how rim 21*e* of lamp 21 does not go around the entire lower edge of the reflector 21*b*. Instead, rim 21*e* is open at the intake port 13 and exhaust port 14 so as to permit air to easily travel to the inside of the reflector 21*b*. These air paths provide cooling of the lamp 21 both on the outside of reflector 21*b*, as well as inside reflector 21*b* around electrode 21*a*. The shape of shell 12 controls the volume, velocity, and direction of the air flow.

In the example of FIG. 1, the exposure of lamp 21 to the airflow from blower 23 is maximized by matching the height, H, of intake port 13 to the height of the bulb portion of the lamp. This permits air to easily circulate uniformly around both sides of the lamp bulb.

By "uniformly" is meant that air passes along the entire height of the bulb as well as around both sides. If desired, the height of intake port 13 can be further extended past the bottom edge of rim 2*le* so as to facilitate the flow of air inside reflector 21*b* and around electrode 21*a*. Blower 23 may have an outlet port that corresponds to port 13 to further maximize the air path.

Shell 12 also has two wiring ports 15, only one of which is visible in FIG. 1. Each port 15 permits wire leads 21*d* from lamp 21 to extend directly from base 21*c* out of housing 10, in a manner that keeps them out of the air path within shell 12.

Alignment collar 17 provides an interface between shell 12 and the mounting surface 11. It may be used to align lamp 21 to the proper position on surface 11. For example, where surface 11 is part of a projector chassis, alignment collar 17 is used to align the lamp electrode 21*a* to the optical axis of the projection optics.

Figure 4:
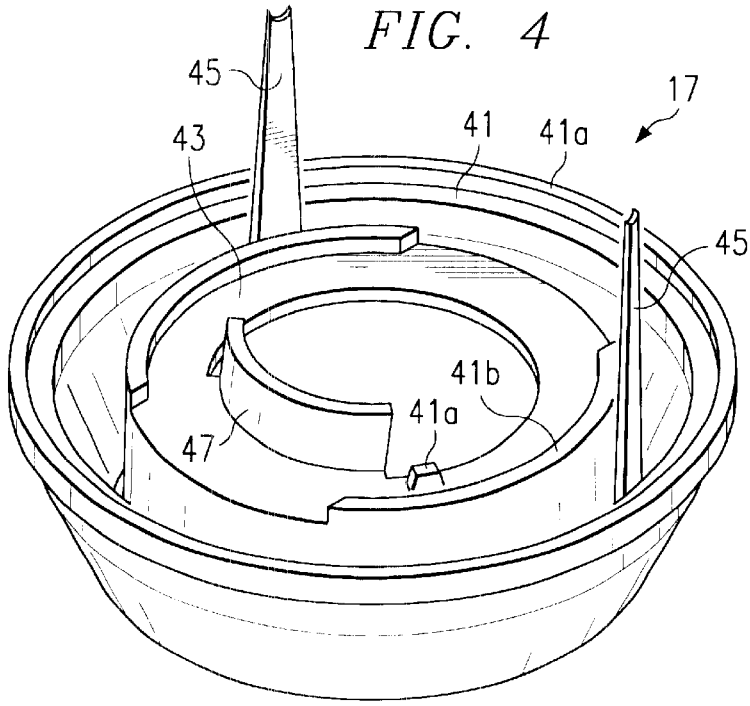
FIG. 4 illustrates the alignment collar of FIG. 1 in further detail.

FIG. 4 is a perspective view of alignment collar 17. As shown, collar 17 has an outer top ring 41 and an inner top ring 43. Shell 12 rests on the outer top ring 41. Lamp 21 rests on the inner top ring 43. Various alignment and seating geometries may be used to align the shell 12 and the lamp 21 to alignment collar 17. As explained above in connection with FIG. 3, to ensure proper air flow, the shell 12 and lamp 21 are aligned such that the openings in rim 2*le* of lamp 21 correspond to the air intake port 13 and exhaust port 15 of the shell 12.

With regard to the alignment of lamp 21 to collar 17, as explained above, rim 21*e* is open at intake port 13 and exhaust port 14; the remaining portions of rim 21*e* rest on an inner top ring 43 of alignment collar 17. Rim 21*e* may be notched to receive a mating protrusion 41*a* on alignment collar 17 to ensure that lamp 21 is properly positioned. Rim 21*e* may rest inside a lip 41*b*, for further security of the lamp 21.

With regard to alignment of shell 12 to collar 17, two prongs 45 extend upwardly from outer ring 41, and are inserted into wiring ports 15. Shell 12 rests inside a lip 41*a* on the outer edge of ring 41. Other alignment means could be easily used.

Referring to FIGS. 1, 2 and 4, alignment collar 17 is seated within the surface 11. Collar 17 has tapered sides to permit it to be easily inserted into and aligned with a mating opening in the surface 11.

FIG. 4 further illustrates a deflector 47, which may be placed on inner top ring 41. Deflector 47 may be used to aid in directing air flow in a desired direction. For example, if deflector 47 is positioned at the air intake port 14, it may assist in directing air to the face of the lamp.

Figure 5:
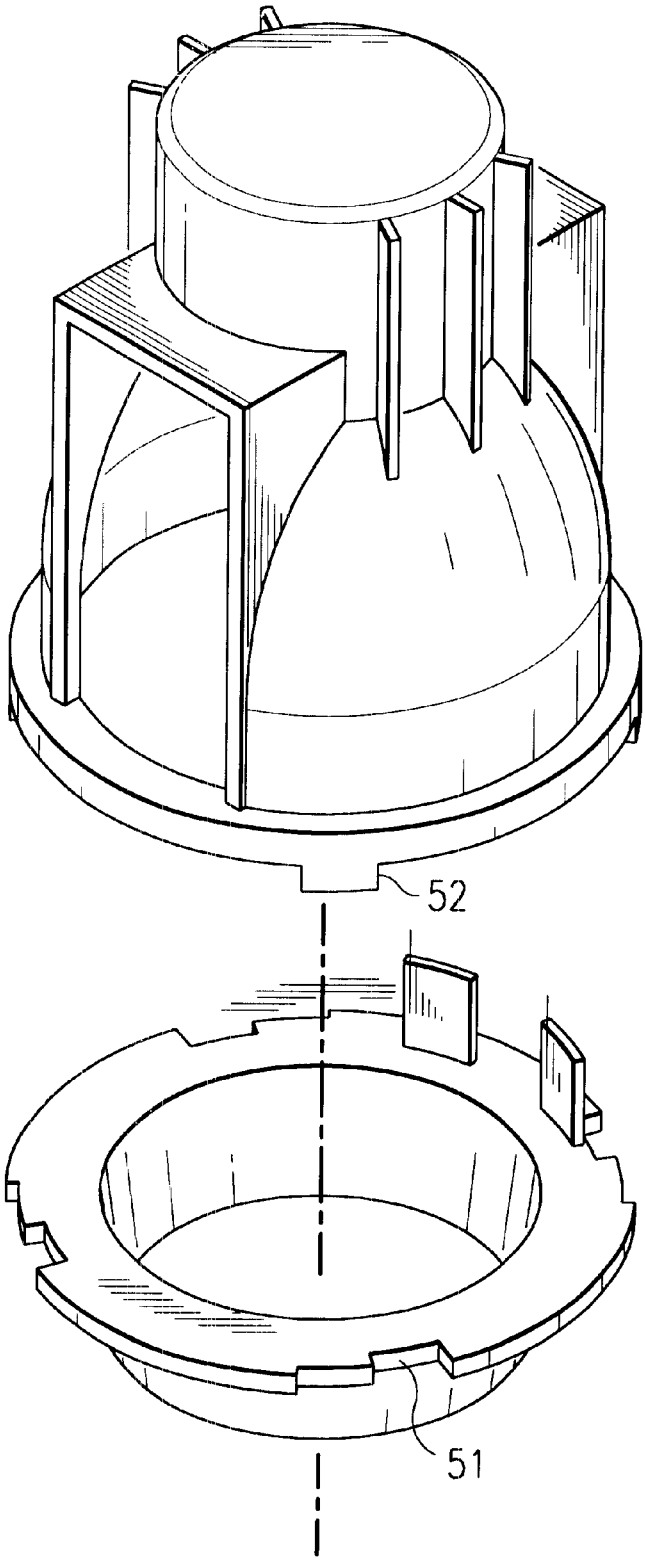
FIG. 5 illustrates an alternative configuration of the interface between the shell and the collar of the housing.

FIG. 5 illustrates an alternative configuration of the interface between shell 12 and collar 17. Ring 41 has small notches 51, each receiving a small flange 52 at the bottom edge of shell 12. A slight twisting movement could be used to move the flanges 52 over the edge of the collar 17 and past the notch and thereby secure the shell 12 onto the collar 17. The shell 12 has a means for attaching the lamp 12 inside the shell 12. For example, notches and tabs, similar to those used to attach shell 12 to collar 17, could be used. Alternatively, collar 17 could have an inner ring, such as the inner ring 43 of FIG. 4, upon which the lamp rests.

Other Embodiments

Although the present invention has been described in detail, it should be understood that various changes, substitutions, and alterations can be made hereto without departing from the spirit and scope of the invention as defined by the appended claims.

What is claimed is:

1. A housing for containing therein and cooling a lamp, the lamp having a face region, a base opposed to said face region and a reflector disposed between said face region and said base to direct light energy from said base toward said base toward said face region, comprising.

a lamp shell for containing the lamp therein, said lamp shell having an inner surface that generally conforms to the outer profile of the reflector but is slightly larger than the lamp such that there is an air space between the inner surface of the lamp shell and the outer profile of the reflector, the lamp shell further having a lower perimeter that is open around the face of the lamp, the lamp shell having an air intake port for receiving air and an air exhaust port for exhausting air, the intake port and the exhaust port being on opposing sides of the shell such that the air at the intake port divides and travels inside the shell in two paths around the lamp in a direction essentially parallel to said face region, and an alignment collar, having an outer top ring for supporting the shell, the alignment collar open to the region of the lamp.

2. The housing of claim 1, wherein the shell has at least one wiring port corresponding to one or more wire leads from the lamp.

3. The housing of claim 1, wherein the air intake port has a height corresponding to the height of the lamp.

4. The housing of claim 1, wherein the shell and the air intake port extend past the rimmed reflector of the lamp.

5. The housing of claim 1, further comprising alignment means on the inner top ring.

6. The housing of claim 5, wherein the alignment means is a protrusion on the ring.

7. The housing of claim 1, further comprising alignment means on the outer top ring.

8. The housing of claim 7, wherein the alignment means is at least one prong extending into the shell.

9. The housing of claim 7, wherein the alignment means are mating notches and flanges.

10. The housing of claim 1, wherein said face region of said lamp is open to the interior of said lamp, further comprising a deflector on the top surface of the collar for directing air in a desired direction to the interior of said lamp via said face region.

11. The housing of claim 1, wherein the reflector has a rim at the of face of the lamp, and wherein the collar has an inner top ring for supporting the rim.

12. The housing of claim 1, wherein the shell has means for attaching the lamp inside the shell.

13. A lamp and associated housing for containing therein and cooling the lamp having a face region, a base opposed to said face region and a reflector disposed between said face region and said base to direct light energy from said base toward said face region, comprising;

lamp having a base, an opposing face region and a reflector disposed between said base and said face region;

a lamp shell for containing the lamp therein, said lamp shell having an inner surface that generally conforms to the outer profile of the reflector but is slightly larger than the lamp such that there is an air space between the inner surface of the [housing]lamp shell and the outer profile of the reflector, the lamp shell further having a lower perimeter that is open around the face of the lamp;

the lamp shell having an air intake port for receiving air and an air exhaust port for exhausting air, the intake port and the exhaust port being on opposing sides of the shell such that the air at the intake port divides and travels inside the shell in two paths around the lamp in a direction essentially parallel to said face region; and an alignment collar, having an outer top ring for supporting the shell, the alignment collar open to the face region of the lamp.

14. The lamp and associated housing of claim 13, wherein said face region of said lamp is open to the interior of said lamp, further comprising a deflector on the top surface of the collar for directing air in a desired direction from said air intake port to the interior of said lamp via said face region and then to said air exhaust port.

* * * * *